US007093472B1

(12) United States Patent
Shore et al.

(10) Patent No.: US 7,093,472 B1
(45) Date of Patent: Aug. 22, 2006

(54) METHOD OF CONTINUOUSLY ROLLING A PRODUCT EXITING FROM AN UPSTREAM ROLL STAND AT A VELOCITY HIGHER THAN THE TAKE IN VELOCITY OF A DOWNSTREAM ROLL STAND

(75) Inventors: T. Michael Shore, Princeton, MA (US); Maurice E. Gauthier, Tiverton, RI (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 11/375,448

(22) Filed: Mar. 14, 2006

(51) Int. Cl.
*B21B 41/00* (2006.01)

(52) U.S. Cl. ..... 72/227; 72/231; 72/66; 242/364

(58) Field of Classification Search ..... 72/66, 72/227, 231, 250, 279, 780; 242/361, 364
See application file for complete search history.

(56) References Cited

U.S. PATENT DOCUMENTS

| | | | | | |
|---|---|---|---|---|---|
| 351,840 | A | | 11/1886 | Lenox | |
| 1,935,048 | A | | 11/1933 | Gassen | |
| 3,486,359 | A | | 12/1969 | Hein | |
| 3,729,972 | A | * | 5/1973 | Kocks | 72/228 |
| 3,774,433 | A | * | 11/1973 | Paules | 72/203 |
| 3,942,350 | A | * | 3/1976 | Brauer et al. | 72/228 |
| 4,028,920 | A | * | 6/1977 | Zander | 72/66 |
| 4,310,031 | A | * | 1/1982 | Appel et al. | 140/2 |
| 4,457,154 | A | * | 7/1984 | Ohba | 72/234 |
| 5,307,663 | A | * | 5/1994 | Shore et al. | 72/228 |
| 5,312,065 | A | * | 5/1994 | Shore et al. | 242/361 |
| 5,595,354 | A | * | 1/1997 | Josoff | 242/364 |
| 5,893,288 | A | * | 4/1999 | Shore | 72/228 |
| 7,021,103 | B1 | * | 4/2006 | Shore | 72/231 |
| 2002/0177972 | A1 | * | 11/2002 | Riches et al. | 702/142 |
| 2004/0250590 | A1 | * | 12/2004 | Shore | 72/250 |

* cited by examiner

*Primary Examiner*—Dmitry Suhol
(74) *Attorney, Agent, or Firm*—Gauthier & Connors LLP

(57) ABSTRACT

A method is disclosed for continuously rolling a product exiting from an upstream roll stand at a delivery velocity $V_1$ higher than the take in velocity $V_3$ of a downstream roll stand. The excess product resulting from the velocity differential between $V_1$ and $V_3$ is temporarily accumulated between the roll stands.

4 Claims, 6 Drawing Sheets

METHOD OF CONTINUOUSLY ROLLING A PRODUCT EXITING FROM AN UPSTREAM ROLL STAND AT A VELOCITY HIGHER THAN THE TAKE IN VELOCITY OF A DOWNSTREAM ROLL STAND

BACKGROUND OF THE INVENTION

1. Field of the Invention

This invention relates generally to rolling mills producing hot rolled long products such as bars, rods, and the like, and is concerned in particular with a method of continuously rolling a product in consecutive upstream and downstream roll stands, with the product exiting from the upstream roll stand at a velocity that is higher than the take in velocity of the downstream roll stand.

2. Description of the Prior Art

In the typical rolling mill installation, billets are heated to an elevated rolling temperature in a furnace. The heated billets are then subjected to continuous rolling in successive roughing, intermediate and finishing sections of the mill, with each mill section being comprised of multiple roll stands. For larger products, the entire mill can usually be operated at or close to the maximum capacity of the furnace. However, when the rolling schedule calls for smaller products, the capacity of the finishing section is often reduced to well below that of the furnace and the roughing and intermediate mill sections. Under these circumstances, the roughing and intermediate sections can be slowed to match the capacity of the finishing section, but there are limits beyond which this becomes impractical. This is because acceptable rolling procedure dictates that the heated billets should be introduced into the first stand of the roughing section at a minimum take in speed, below which fire cracking of the rolls can take place.

In other cases, for example, when rolling high speed tool steels or nickel based alloys, a higher take in speed is required to avoid excess cooling of the billet, while lower finishing speeds are required to avoid excessive heat generation, which can cause core melting and surface cracking of the product.

These problems can be avoided by continuously rolling a product in consecutive upstream and downstream roll stands, e.g., the last stand of an intermediate mill section and the first stand of a mill finishing section, with the velocity of the product exiting from the upstream stand being higher than the take in velocity of the downstream stand, and with the excess product resulting from this velocity differential being temporarily accumulated between the two roll stands.

One prior attempt at achieving this objective is disclosed in U.S. Pat. No. 3,486,359 (Hein), where a laying head temporarily accumulates hot rolled products exiting from the intermediate mill section on a storage reel. The accumulated product is then unwound from the storage reel at a reduced speed for continued rolling in a mill finishing section. However, a number of drawbacks are associated with the Hein approach. For example, the product is not decelerated prior to being wound onto the storage reel. This, coupled with a lack of control over how the windings are distributed along the reel surface, can cause the windings to overlap one another, and this in turn can disrupt the unwinding process.

In U.S. Published application No. US2004-0250590A1 (Shore), a different system is disclosed for decelerating and temporarily accumulating a hot rolled product moving longitudinally along a receiving axis at a first velocity $V_1$. The Shore system includes a continuously rotating laying assembly having an entry end aligned with the receiving axis to receive the product. The laying assembly has a curved intermediate section leading to delivery end that is spaced radially from the receiving axis and that is oriented to deliver the product in an exit direction transverse to the receiving axis. The curvature of the laying assembly and the orientation of its delivery end is such that the exiting product is formed into a helix. The helix is received and temporarily accumulated on a cylindrical drum arranged coaxially with the receiving axis. The drum is rotated continuously about the receiving axis in a direction opposite to the direction of rotation of the laying assembly and at a speed selected to unwind the accumulating helix at the velocity $V_3$. The unwinding product is directed away from the drum by a catcher that is shiftable in a direction parallel to the receiving axis. During the time "T" required to roll a complete billet, a product length "L" equal to $T \times V_2$ is temporarily accumulated on the drum.

In the Shore system, the product is decelerated and formed into an ordered helix prior to being deposited on the drum. Product deceleration reduces the required storage capacity of the drum, and the ordered helix insures a smooth and trouble free unwinding of the product from the drum.

An essential requirement of the Shore system is accurate prediction of the time of arrival of the product front end at the delivery end of the continuously rotating laying assembly, coupled with precise synchronization of the rotating laying assembly with reference to the stationary catcher so as to insure smooth delivery of the product front end from the former to the latter.

The objective of the present invention is to provide an alternative method of operating the Shore system in which the laying assembly is stationary during delivery of product front ends to the catcher.

SUMMARY OF THE INVENTION

In accordance with the present invention, a product is rolled in consecutive upstream and downstream roll stands, with the product exiting from the upstream roll stand at a velocity $V_1$ that is higher than the take in velocity $V_3$ of the downstream roll stand. The product exiting from the upstream roll stand is directed along a delivery axis to an accumulator arranged between the roll stands. The accumulator has a curved laying assembly with an entry end aligned with the delivery axis to receive the product, and an exit end spaced radially from the delivery axis to deliver the product in a transverse direction. During a first time interval, the laying assembly is maintained stationary, with its exit end aligned with a catcher leading to the downstream roll stand, thereby delivering the product via the catcher for rolling in the downstream roll stand at its take in velocity $V_3$, while excess product resulting from the velocity differential $V_1-V_3$ continues to be delivered from the upstream roll stand. The excess product is temporarily stored in a looper arranged between the accumulator and one of the roll stands. During a second time interval, the laying assembly is rotatably accelerated about the delivery axis to an operational speed at which its exit end has a velocity $V_2$ equal to $V_1-V_3$, thereby decelerating the product being delivered from its exit end to the velocity $V_3$. During a third time interval, the laying assembly continues to rotate at its operational speed, with the curvature of the laying assembly and the orientation of its exit end being such as to form the product delivered there from in excess of that being rolled in the downstream roll stand into a helix. The helix is deposited and accumulated on a cylindrical drum rotatable about the delivery axis, and the drum is rotated in a direction opposite to the direction of rotation of the laying assembly to thereby unwind the helix via the catcher to the downstream roll stand at velocity $V_3$.

Preferably, the velocity of the product entering and exiting from the accumulator is controlled respectively by upstream and downstream driven pinch roll units.

In accordance with one aspect of the invention, the looper is arranged between the downstream pinch roll unit and the downstream roll stand. The upstream and downstream pinch roll units are operated to maintain the velocity of the product at $V_1$ during the first time interval. During the second time interval, the downstream pinch roll unit is operated to decelerate the product from $V_1$ to $V_3$ at a rate inverse to the rate of acceleration of the curved guide to $V_2$.

In accordance with another aspect of the invention, the looper is arranged between the upstream pinch roll unit and the upstream roll stand. During the first time interval, the upstream pinch roll unit is operated at velocity $V_3$ and the downstream pinch roll unit is operated at velocity $V_3$. During the second time interval, the upstream pinch roll unit is operated to accelerate the product from velocity $V_3$ to velocity $V_1$ at the same rate as the rate of acceleration of the curved guide to $V_2$.

These and other features and attendant advantages of the present invention will now be described in further detail with reference to the accompanying drawings, wherein:

DETAILED DESCRIPTION OF PREFERRED EMBODIMENTS

Figure 1:
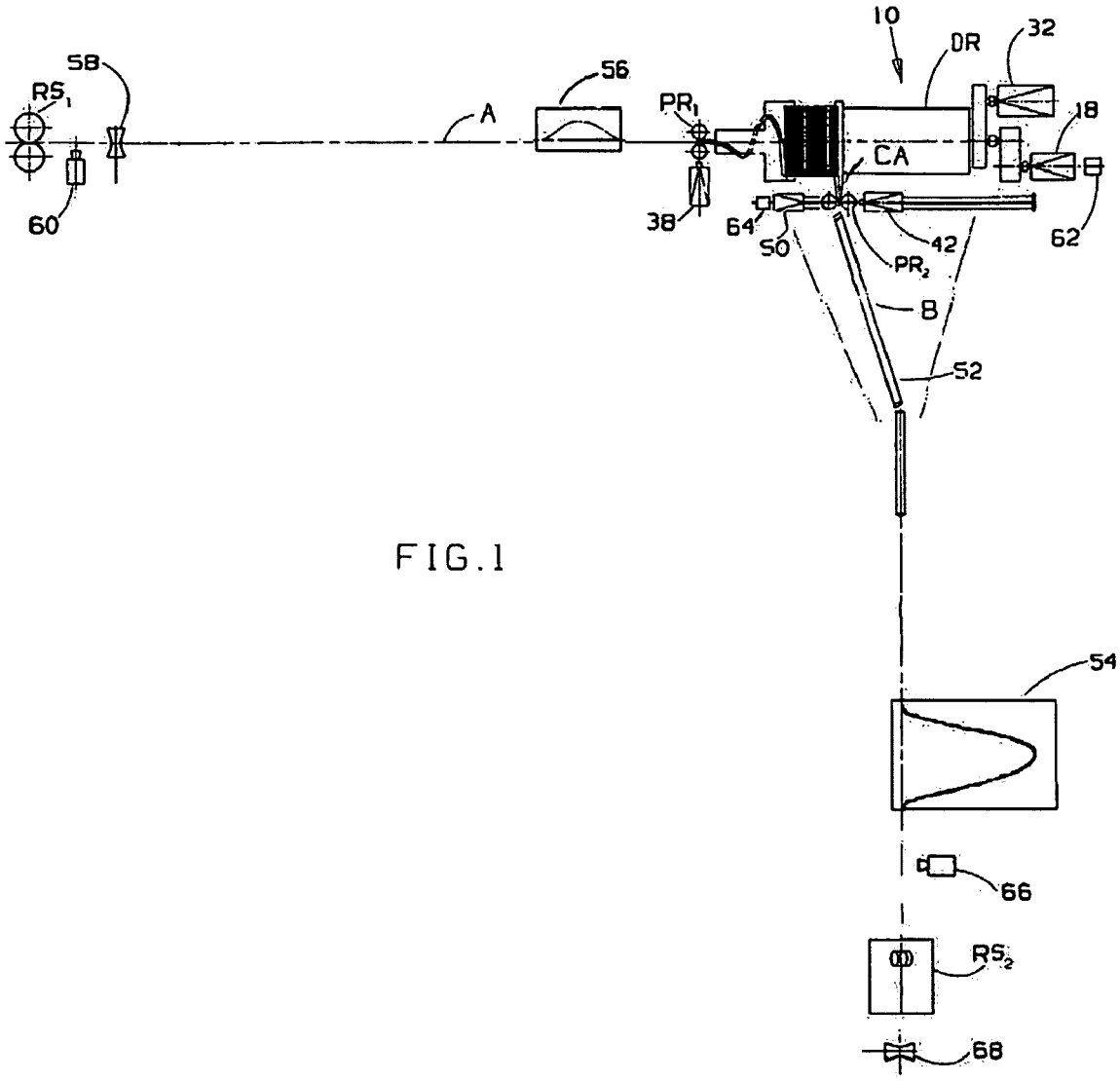
FIG. 1 is a diagrammatic illustration of a mill layout in accordance with one aspect of the present invention.

With reference initially to FIG. 1, an accumulator 10 is positioned to receive a hot rolled bar along a delivery axis "A" from an upstream roll stand $RS_1$, and to deliver the product to a downstream roll stand $RS_2$ along a path "B" transverse to axis A.

With reference additionally to FIGS. 2 to 5, it will be seen that the accumulator 10 comprises a drive shaft 14 supported between bearings for rotation about axis A. One end of the drive shaft is coupled to the output shaft of a gear box 16 which in turn is driven by a motor 18.

Figure 4:
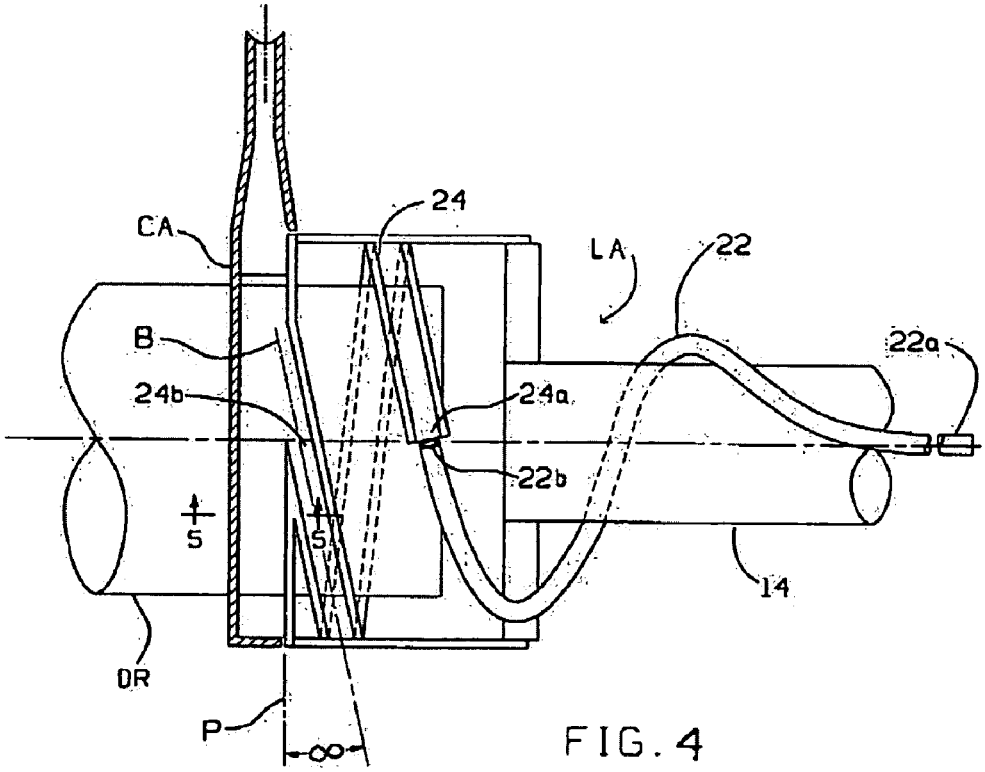
FIG. 4 is an enlarged plan view of a portion of the accumulator.
Figure 5:
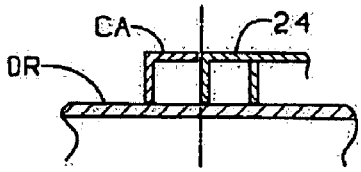
FIG. 5 is a sectional view taken along line 5—5 of FIG. 4.

As can best be seen in FIG. 4, the opposite end of the drive shaft 14 is configured and arranged to support a curved laying assembly LA comprising a laying pipe 22 and a helical trough extension 24.

The laying pipe has an entry end 22*a* aligned with the axis A to receive the hot rolled product, and a curved intermediate section leading to an exit end 22*b* communication with the entry end 24*a* of the helical trough. The exit end 24*b* of the trough is spaced radially from the axis A and oriented to deliver the product in an exit direction along the path B.

Although not shown, it will be understood by those skilled in the art that in place of the laying pipe 22 and/or the helical trough 24, a series of rollers may be employed to define the path of the curved laying assembly LA.

Figure 3:
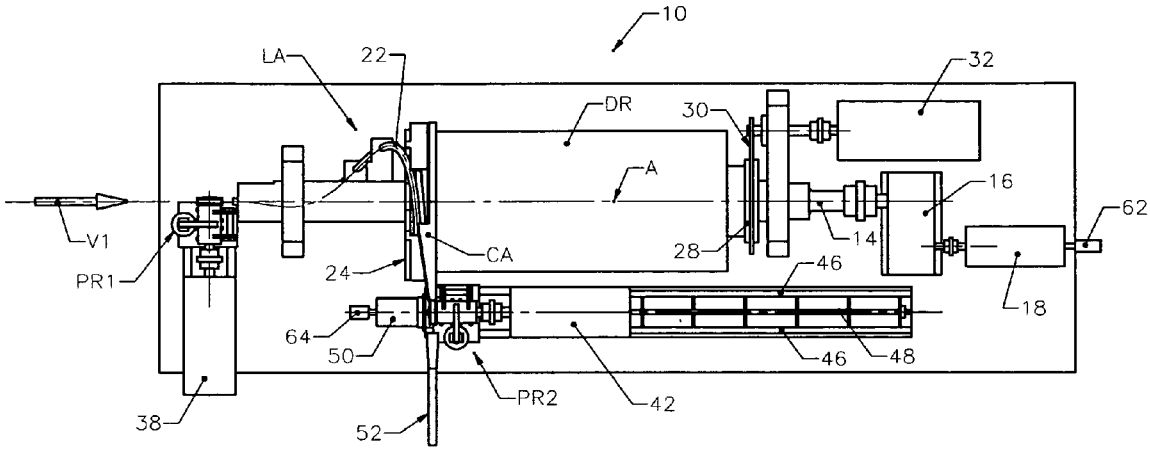
FIG. 3 is a plan view of the accumulator.

As can best be seen in FIGS. 3 and 4, a cylindrical drum DR is carried by and freely rotatable on the drive shaft 14. One end of the drum is partially overlapped by the exit end of the curved laying assembly LA. A driven sprocket 28 on the opposite end of the drum DR is mechanically coupled by a drive chain 30 to a drive sprocket on the output shaft of a second motor 32.

The helical trough extension 24 rotates with the laying pipe 22 and coacts with the surface of drum 26 to provide an extension of the guide path defined by the laying pipe. This extension is sufficient to insure that the exiting product is formed into a helical formation of rings.

A catcher "CA" is arranged to receive product exiting from the delivery end 24*b* of trough 24 and to direct the product along path B.

An upstream pinch roll unit $PR_1$ driven by motor 38 controls the speed of the product entering the accumulator 10, and downstream pinch roll unit $PR_2$ driven by motor 42 controls the speed of the product exiting from the accumulator. The catcher CA and the downstream pinch roll unit $PR_2$ are carried on a carriage 44 movable along rails 46 parallel to the axis A. Carriage 44 is threadedly engaged by a screw shaft 48 driven by a motor 50. The catcher CA and associated downstream pinch roll unit $PR_2$ are arranged to direct the product being delivered from the exit end 24*b* of the trough 24 to a pivotal delivery guide trough 52. Trough is arranged to pivot in order to accommodate movement of the carriage 44 along rails 46.

Motor 50 is controlled to maintain the catcher CA in alignment with the product being unwound from the helix temporarily accumulating on drum DR. Thus, during an initial stage of the unwinding cycle, motor 50 will operate to traverse the carriage 44 away from the trough 24, and during the final stage of the unwinding cycle, motor 50 will reverse to traverse the carriage back towards the trough.

In the layout depicted in FIG. 1, the pivotal delivery trough 52 leads to a looper 54 positioned between the downstream pinch roll unit $PR_2$ and the downstream roll stand $RS_2$. A smaller looper 56 may also be provided along axis A between the upstream pinch roll unit $PR_1$ and the upstream roll stand $RS_1$.

A hot metal detector 58 detects the exit of the product front end from the upstream roll stand $RS_1$, and a velocity gauge 60 measures the velocity of the product. Encoders 62, 64 provide signals indicative of the rotational position of the delivery end 24*b* of helical trough 24, and the position of the carriage 44 carrying the catcher CA and downstream pinch rolls $PR_2$. A second velocity gauge 66 measures the velocity of the product entering the downstream roll stand $RS_2$, and a hot metal detector 68 detects the exit of the product front end from roll stand $RS_2$.

Figure 6:
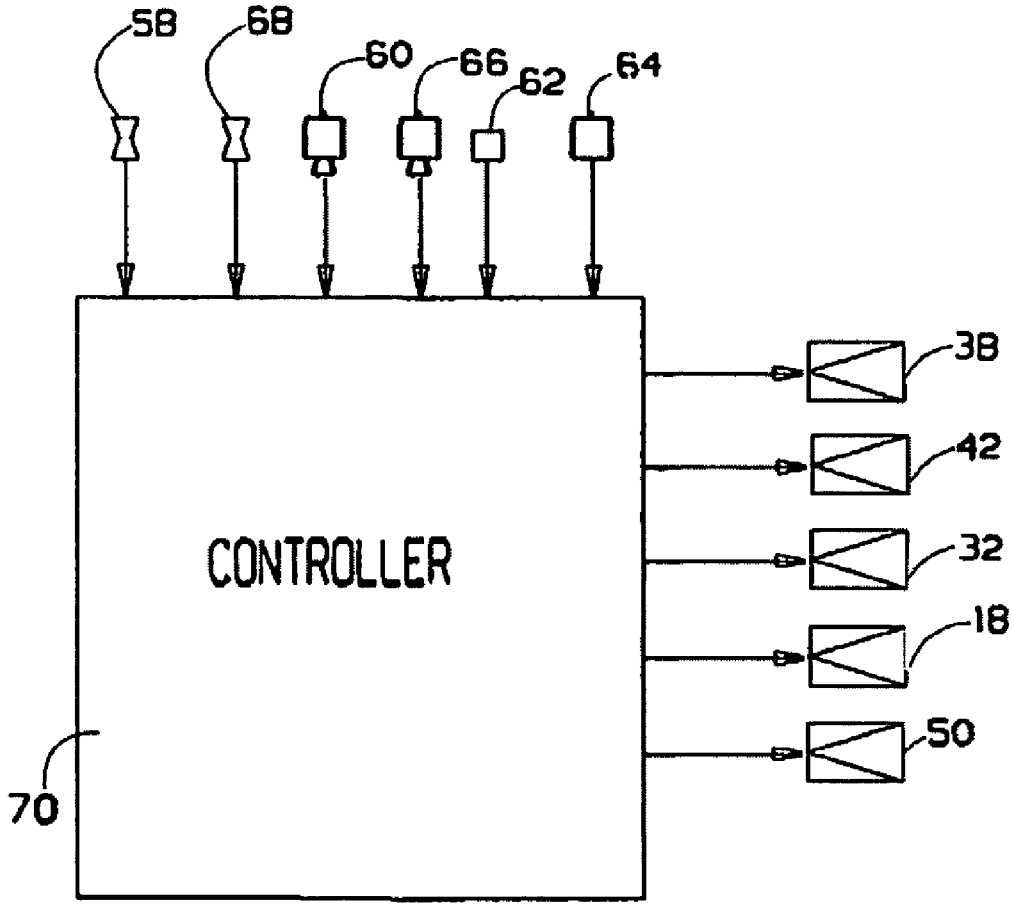
FIG. 6 is a control diagram.

As shown in FIG. 6, a controller 70 receives signals from the velocity gauges 60, 66, the hot metal detectors 58, 68, and the encoders 62,64, and operates to control the speed of motors 18, 32, 38, 42, and 50.

In an exemplary rolling sequence employing the mill layout of FIG. 1, a hot rolled bar exits the upstream roll stand $RS_1$ at a velocity $V_1$. The downstream roll stand $RS_2$ operates at a slower take in velocity $V_3$.

During a first time interval, the curved laying assembly LA is stationary with the delivery end 24*b* of the trough 24 aligned with the catcher CA, also stationary, as shown in FIG. 4.

Figure 7:
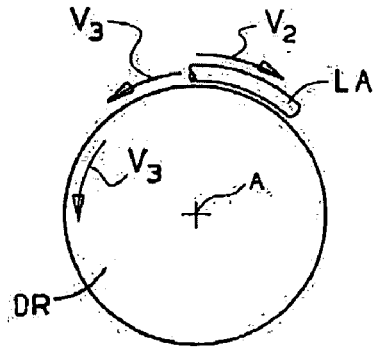
FIG. 7 is a diagrammatic illustration of the relative movement of components of the accumulator.

The encoder 62 provides the controller 70 with a control signal indicative of the angular position of the trough delivery end 24*b*. Likewise, the encoder 64 provides a control signal indicative of the position of the carriage 44 and catcher CA along rails 46. The controller employs these control signals to operate motors 18 and 50 to achieve the aforesaid stationary alignment. The pinch roll units $PR_1$ and $PR_2$ are each operated at velocity $V_1$, and the excess product resulting from the velocity differential $V_2$ equal to $V_1$–$V_3$ is temporarily stored in the looper 54. The drum DR is rotated continuously at a surface velocity $V_3$ in a counter clockwise direction as viewed in FIG. 7.

After the product front end has exited the downstream roll stand $RS_2$, and during a second time interval, the following events occur simultaneously:

(a) the laying assembly LA is rotatably accelerated to velocity $V_2$, resulting in a deceleration of the product exiting the delivery end 24*a* of trough 24 to a reduced velocity $V_3$ equal to the take in velocity of the downstream roll stand $RS_2$;

(b) the pinch roll unit $PR_2$ is decelerated from velocity $V_1$ to velocity $V_3$ at a rate inverse to the rate of acceleration of the laying assembly LA, with the excess product resulting from the velocity differential between $V_1$ and $V_3$ being stored as a helix on drum DR; and (c) motor 50 is energized to move the carriage 44 carrying the pinch roll unit $PR_2$ and the catcher CA along the tracks 46, thereby maintaining the catcher in alignment with the unwinding helix.

During a third time interval, after the acceleration of the laying assembly and the deceleration of the pinch roll unit $PR_2$, has been completed, and for the time it takes to process the entire length of the bar, the system remains in equilibrium, with the various components operating as follows:

$PR_1$ at $V_1$ $PR_2$ at $V_3$

LA at $V_2$

DR at $V_3$

CA (moving)

Figure 8:
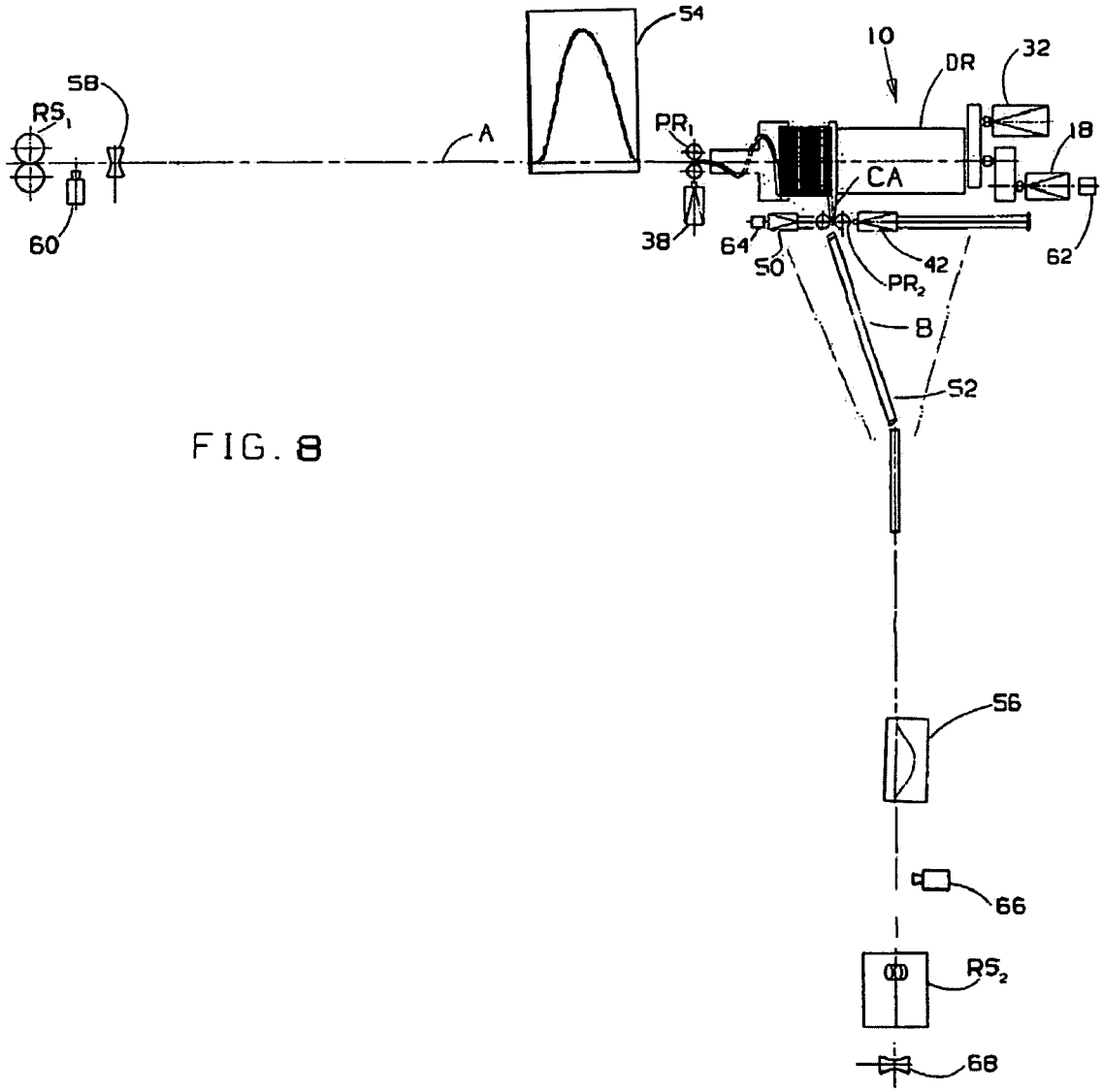
FIG. 8 is an illustration similar to FIG. 1 showing another aspect of the present invention.

In the layout shown in FIG. 8, the positions of the loopers 54 and 56 are reversed, requiring a slightly different method of operation. More particularly, during the first time interval, the curved laying assembly LA is again stationary with the delivery end 24*b* of the trough 24 aligned with the stationary catcher CA. Pinch roll unit $PR_1$ is operating at velocity $V_3$ and pinch roll unit $PR_2$ is operating at $V_3$. The excess product resulting from the velocity differential $V_1$–$V_3$ is again temporarily stored in the looper 54.

During the second time interval, pinch roll unit $PR_1$ is accelerated from $V_3$ to $V_1$, the laying head assembly is rotatably accelerated at the same rate to $V_2$, and motor 50 is again activated to maintain the catcher CA and pinch roll unit $PR_2$ in alignment with the product unwinding from drum DR.

The system operation during the third time interval is the same as that described above for the FIG. 1 layout. Both operational modes are summarized in the following table.

Figure 2:
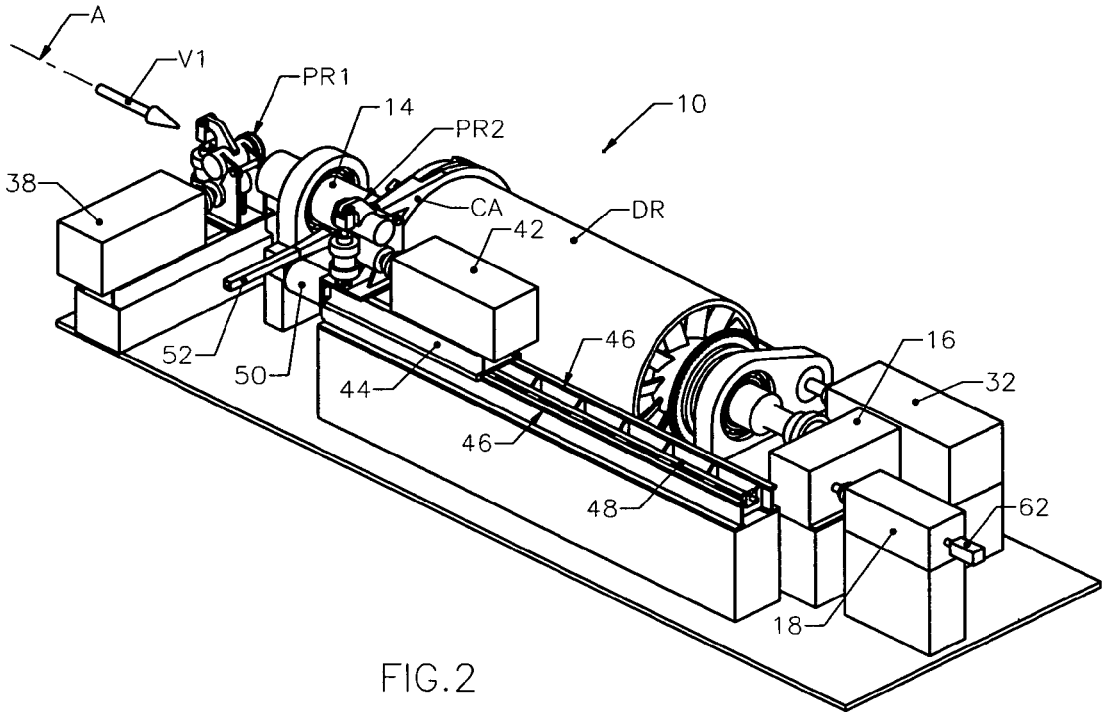
FIG. 2 is a perspective view of the accumulator depicted in FIG. 1.

| | TIME INTERVALS | | |
|---|---|---|---|
| | FIRST | SECOND | THIRD |
| FIG. 1 | $PR_1 = V_1$ | $PR_1 = V_1$ | $PR_1 = V_1$ |
| | $PR_2 = V_1$ | $PR_2 = V_1 - V_3$ | $PR_2 = V_3$ |
| | LA = 0 | LA = 0 – $V_2$ | LA = $V_2$ |
| | DR = $V_3$ | DR = $V_3$ | DR = $V_3$ |
| | CA (Stationary) | CA (moving) | CA (moving) |
| FIG. 2 | $PR_1 = V_3$ | $PR_1 = V_3 - V_1$ | $PR_1 = V_1$ |
| | $PR_2 = V_3$ | $PR_2 = V_3$ | $PR_2 = V_3$ |
| | LA = 0 | LA = 0 – $V_2$ | LA = $V_2$ |
| | DR = $V_3$ | DR = $V_3$ | DR = $V_3$ |
| | CA (Stationary) | CA (moving) | CA (moving) |

In light of the foregoing, it will be seen that by employing a looper 54, either upstream or downstream of the accumulator 10, to temporarily store excess product resulting from the velocity differential between $V_1$ and $V_3$, the laying assembly LA can remain stationary with the delivery end 24*a* of the trough 24 in alignment with the stationary catcher CA until a product front end has passed through and been accepted by the downstream roll stand $RS_2$.

We claim:

1. A method of continuously rolling a product in consecutive upstream and downstream roll stands, with the product exiting from the upstream roll stand at a velocity $V_1$ that is higher than the take in velocity $V_3$ of the downstream roll stand, said method comprising:

directing the product exiting from the upstream roll stand along an axis to an accumulator arranged between said roll stands, said accumulator having a curved laying assembly with an entry end aligned with said axis to receive said product, and an exit end spaced radially from said axis to deliver said product in an exit direction transverse to said axis;

during a first time interval, maintaining said laying assembly stationary, with its exit end aligned with a guide leading to said downstream roll stand, thereby delivering said product via said guide for rolling in said downstream roll stand at its take in velocity $V_3$, while excess product resulting from the velocity differential $V_1$–$V_3$ continues to be delivered from said upstream roll stand;

temporarily storing said excess product in a looper arranged between said accumulator and one of said roll stands;

during a second time interval, rotatably accelerating said laying assembly about said axis to an operational speed at which said exit end has a velocity $V_2$ equal to $V_1$–$V_3$, thereby decelerating the product being delivered from said exit end to the velocity $V_3$;

during a third time interval, continuing to rotate said laying assembly at said operational speed, the curvature of said laying assembly and the orientation of said exit end being such as to form the product delivered from said exit end in excess of that being rolled in said downstream roll stand into a helix;

depositing and accumulating said helix on a cylindrical drum rotatable about said axis; and rotating said drum in a direction opposite to the direction of rotation of said laying assembly to thereby unwind said helix via said guide to said downstream roll stand at velocity $V_3$.

2. The method of claim 1 further comprising controlling the velocity of the product entering and exiting from said accumulator respectively with upstream and downstream driven pinch roll units.

3. The method of claim 2 wherein said looper is arranged between said downstream pinch roll unit and said downstream roll stand, operating said upstream and downstream pinch roll units to maintain the velocity of said product at $V_1$ during said first time interval, and operating said downstream pinch roll unit during said second time interval to decelerate said product from $V_1$ to $V_3$ at a rate inverse to the rate of acceleration of said curved guide.

4. The method of claim 2 wherein said looper is arranged between said upstream pinch roll unit and said upstream roll stand, operating said upstream pinch roll unit at velocity $V_3$ and said downstream pinch roll unit at velocity $V_3$ during said first time interval, and accelerating said upstream pinch roll unit during said second time interval to accelerate said product from $V_3$ to $V_1$ at the same rate as the rate of acceleration of said curved guide.

* * * * *